US010662739B2

(12) United States Patent
Saraya et al.

(10) Patent No.: US 10,662,739 B2
(45) Date of Patent: May 26, 2020

(54) METHODS AND SYSTEMS FOR A FRAC SLEEVE

(71) Applicant: Vertice Oil Tools, Sugarland, TX (US)

(72) Inventors: Mohamed Saraya, Sugarland, TX (US); Hossam Elbadawy, Katy, TX (US)

(73) Assignee: VERTICE OIL TOOLS, Missouri City, TX (US)

( * ) Notice: Subject to any disclaimer, the term of this patent is extended or adjusted under 35 U.S.C. 154(b) by 164 days.

(21) Appl. No.: 15/859,670

(22) Filed: Jan. 1, 2018

(65) Prior Publication Data

US 2019/0203566 A1 Jul. 4, 2019

(51) Int. Cl.

| | |
|---|---|
| ***E21B 34/14*** | (2006.01) |
| ***E21B 34/10*** | (2006.01) |
| ***E21B 34/06*** | (2006.01) |
| ***E21B 43/08*** | (2006.01) |
| *E21B 34/00* | (2006.01) |

(52) U.S. Cl.

CPC ..... *E21B 34/10* (2013.01); *E21B 34/063* (2013.01); *E21B 34/14* (2013.01); *E21B 43/08* (2013.01); *E21B 2034/005* (2013.01); *E21B 2034/007* (2013.01)

(58) Field of Classification Search

CPC ..... E21B 34/10; E21B 34/102; E21B 34/103; E21B 34/14

See application file for complete search history.

(56) References Cited

U.S. PATENT DOCUMENTS

| | | | | |
|---|---|---|---|---|
| 4,893,678 | A * | 1/1990 | Stokley | E21B 33/127 166/238 |
| 8,616,285 | B2 | 12/2013 | Tinker et al. | |
| 8,733,445 | B2 | 5/2014 | Huang | |
| 9,482,071 | B2 * | 11/2016 | Carrejo | E21B 34/063 |
| 9,574,421 | B1 * | 2/2017 | Saraya | E21B 34/14 |
| 2008/0110673 | A1 | 5/2008 | Giroux et al. | |
| 2009/0044944 | A1 * | 2/2009 | Murray | E21B 43/02 166/308.1 |
| 2011/0056692 | A1 | 3/2011 | Cardenas et al. | |
| 2011/0073321 | A1 * | 3/2011 | Fay | E21B 23/04 166/373 |
| 2011/0203800 | A1 | 8/2011 | Tinker et al. | |
| 2011/0284232 | A1 * | 11/2011 | Huang | E21B 21/103 166/317 |
| 2012/0012322 | A1 | 1/2012 | Korkmaz et al. | |
| 2012/0043093 | A1 | 2/2012 | Cravette | |
| 2012/0199341 | A1 | 8/2012 | Kellner et al. | |
| 2012/0227973 | A1 | 9/2012 | Hart et al. | |
| 2013/0048290 | A1 | 2/2013 | Howell et al. | |

(Continued)

FOREIGN PATENT DOCUMENTS

| | | |
|---|---|---|
| WO | WO2014/082054 A1 | 5/2014 |
| WO | PCT/US16/68315 | 10/2017 |
| WO | WO2017171951 | 10/2017 |

*Primary Examiner* — William D Hutton, Jr.
*Assistant Examiner* — Steven A Macdonald
(74) *Attorney, Agent, or Firm* — Pierson IP, PLLC

(57) ABSTRACT

A frac sleeve with an expandable ball seat. More specifically, the systems and methods include a hydraulically sliding frac sleeve with a moving screen, check valve or flapper that is configured to be align with a fixed production port positioned on an outer sidewall.

20 Claims, 3 Drawing Sheets

(56) References Cited

U.S. PATENT DOCUMENTS

| | | | | |
|---|---|---|---|---|
| 2013/0168099 | A1* | 7/2013 | Themig | E21B 34/103<br>166/308.1 |
| 2014/0060813 | A1* | 3/2014 | Naedler | E21B 34/06<br>166/135 |
| 2014/0251629 | A1 | 9/2014 | Castro | |
| 2014/0318816 | A1 | 10/2014 | Hofman | |

* cited by examiner

METHODS AND SYSTEMS FOR A FRAC SLEEVE

BACKGROUND INFORMATION

Field of the Disclosure

Examples of the present disclosure relate to a sliding frac sleeve with a screen, check valve or flapper. More specifically, embodiments include screen with a frac sleeve, wherein the screen, check valve or flapper is configured to align with a port within casing.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Additionally, during the fracturing process, tools may be pumping through frac sleeves to enhance the production of the natural resources. One of the tools pumped through the frac sleeves are frac-balls, or similar devices, herein will be referred collectively as frac balls. The frac-balls are configured to block off or close portions of a well to allow pressure to build up, causing the cracks or fractures in the geological formations and in other cases to shut these openings and isolate existing fracture to prevent production of un-required fluid.

Current or existing completion strings that utilize frac sleeves in wellbores are comprised of a plurality of frac sleeves, each having have tapered sidewalls. In order to activate each frac sleeve, properly sized frac-balls are pumped along with the mixture inside of the wellbore. Subsequent pumped frac-balls may have a larger diameter. The larger is smaller than the opening of all of the upper frac sleeves, but larger than the sleeve it is intended to open. Thus, current or existing completion strings that utilizes frac sleeves in wellbores require frac-balls of proper size to be sequentially pumped into a completion string.

When a properly sized frac-ball is positioned within a corresponding frac sleeve, the positioning of the frac-ball exerts pressure causing the frac sleeve activation or opening, consequently causing the pressure to fracture or crack in the geological formation. At the completion of each fracturing stage, a larger sized frac-ball is injected into the completion string, which opens up the next frac sleeve. This process repeats until all of the frac sleeves are opened, and multiple fractures are created in the wellbore.

Thus, conventional wellbores force fracturing to occur at the lowest frac sleeve first. This causes completion strings to be prone to accumulate undesired sand or mixtures in the wellbore after a fracking stage. Additionally, conventional wellbores rely on tapered frac sleeves corresponding to different sized frac-balls. This limits the number of stages in a completion string and frac rate due to the huge pressure drop across the frac sleeves with the smallest ball seats and limits the ability to efficiently treat the geological formation under consideration. After the multiple fractures are created in conventional wellbores, additional fractures cannot be created without intervention for mechanical activation.

Further, there is a need to develop a tool that retain and prevent sand pumped into the formation from flowing back into the wellbore and the surface since this may cause the fracture or cracks to close again.

Accordingly, needs exist for system and methods utilizing a sliding frac sleeve with a screen, check valve or flapper, wherein the screen, check valve or flapper is configured to be aligned and misaligned with a port positioned through casing.

SUMMARY

Embodiments disclosed herein describe a frac sleeve with or without an expandable ball seat, for simplicity the embodiments include an expandable seat. More specifically, embodiments include an expandable ball seat within a frac sleeve configured to allow a single ball to treat a plurality of zones associated with a plurality of frac sleeves.

Embodiments may include a frac sleeve with an outer sidewall and an inner sleeve.

The outer sidewall may include an outer frac port, recess, and a vertically adjustable member.

The inner sleeve may include an inner frac port, an expandable ball seat, and a screen, check valve or flapper.

In embodiments, a frac-ball may be dropped within the inner sleeve and positioned on the expandable ball seat, seat, dynamic seal that is configured to be opened and closed, etc. (referred to hereinafter collectively and individually as "expandable ball seat"). When the frac-ball is positioned on the expandable ball seat, pressure may be applied within the frac sleeve to compress the vertically adjustable member. Responsive to compressing the vertically adjustable member, the inner sleeve may slide vertically within the outer sidewall.

In embodiments, responsive to vertically moving the inner sleeve, the outer frac port may become aligned with the inner frac port. When the outer frac port and inner frac port are aligned, fracking fluid may be transmitted from a position within the inner sleeve to a position outside of the outer sidewall via the aligned frac ports. The pressure within the inner diameter of the tool may remain a fluid threshold based on the pumping of fracking fluid through the inner diameter of the frac sleeve.

In embodiments, as the pressure within the frac sleeve is decreased, based on no longer pumping the fracking fluid through the inner diameter of the frac sleeve, the vertically adjustable member may expand or contract. Responsive to the expanding or contracting of the vertically adjustable member, the inner frac sleeve may slide upward causing the expandable ball seat to be aligned with the recess. When the expandable ball seat is aligned with the recess, the expandable ball seat may expand horizontally into the recess. Once the expandable ball seat expands, a diameter of the expandable ball seat may have a diameter that is greater than the frac-ball. This may allow the frac-ball to slide through the vertically adjustable member and into a lower positioned, second frac sleeve.

Additionally, when the vertically adjustable member is expanded, the screen, check valve or flapper on the inner sleeve may be aligned with the outer frac port. In embodiments, the screen, check valve or flapper may be configured to filter materials flowing from the geological formation into the frac sleeve including sand that has been pumped, allowing only hydrocarbon and other fluids to flow into or out of the frac sleeve.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
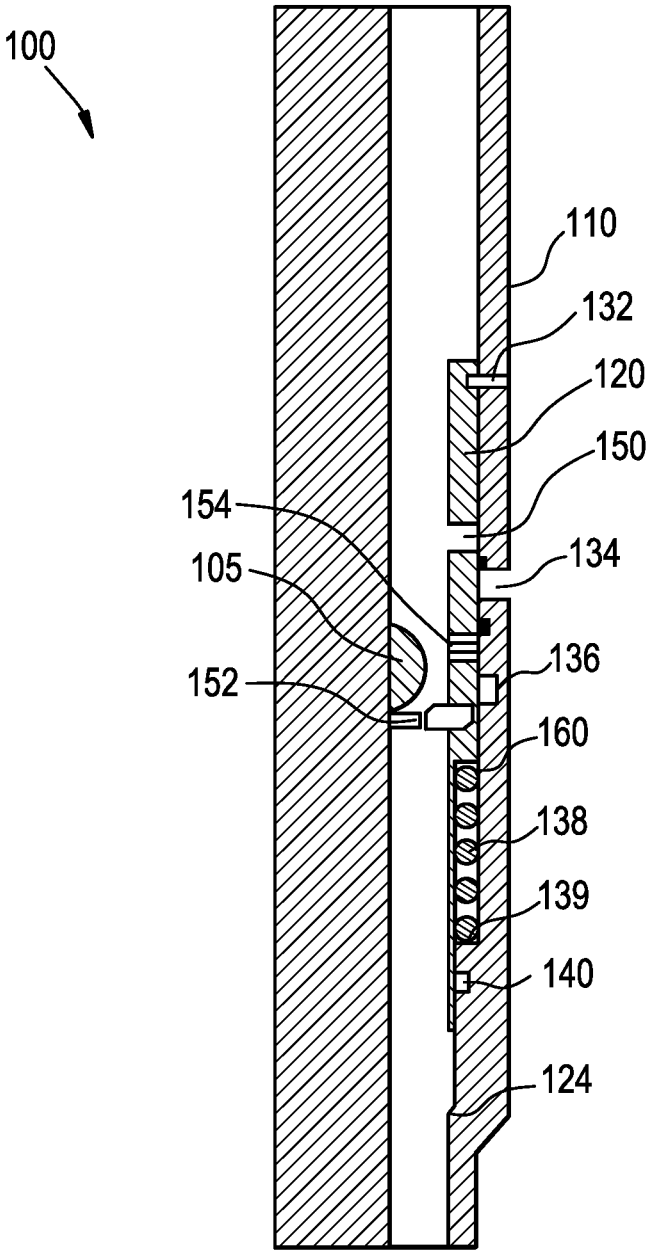
FIG. 1-3 depict operations associated with a frac sleeve, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a frac sleeve 100, according to an embodiment. In embodiments, a wellbore may include a plurality of frac sleeves 100, which may be vertically aligned across their axis with one another. The plurality of frac sleeves 100 may be aligned such that a first frac sleeve 100 is positioned above a second frac sleeve 100. Each frac sleeve 100 may be utilized to control the flow of fluid, gases, mixtures, etc. within a stage of a wellbore.

Frac sleeve 100 may include outer sidewall 110 and inner sleeve 120, wherein a frac ball 105 may be configured to be positioned within a hollow chamber. The frac ball 105 may be configured to control a pressure within the hollow chamber to allow for relative movement of elements of frac sleeve 100.

Outer sidewall 110 and inner sleeve 120 may include the hollow chamber, channel, conduit, passageway, etc. The hollow chamber may extend from a top surface of outer sidewall 110 and inner sleeve 120 to a lower surface of outer sidewall 110 and inner sleeve 120.

Inner sleeve 120 may be positioned within the hollow channel, and be positioned adjacent to outer sidewall 110. In embodiments, an outer diameter of inner sleeve 120 may be positioned adjacent to an inner diameter of outer sidewall 110. Outer sidewall 110 and inner sleeve 120 may have parallel longitudinal axis, and may not include tapered sidewalls.

Outer sidewall 110 may include upper shear screws 132, outer frac port 134, recess 136, vertically adjustable member 138, and lower shear ring 140.

Upper shear screws 132 may be positioned within outer sidewall 110, and extend into portions of inner sleeve 120. Upper shear screws 132 may be configured to temporarily couple inner sleeve 120 with outer sidewall 110. When coupled together, inner sleeve 120 may be secured to outer sidewall 110 at a fixed position within the hollow chamber of outer sidewall 110. Inner sleeve 120 and outer sidewall 110 may remain coupled until a predetermined amount of force is applied within the hollow chamber, wherein the force within inner sleeve 120 may be generated by pumping fluid through the hollow chamber. Responsive to the predetermined amount of force being applied within the hollow chamber, upper shear screws 132 may break, be removed, etc., and allow inner sleeve 120 to slide downward and/or upward relative to outer sidewall 110.

Outer frac port 134 may be an opening, orifice, etc. extending through outer sidewall 110. Outer frac port 134 may be configured to control the flow of fluid, fracking materials, natural resources and any fluid through the hollow chamber. In embodiments, outer frac port 134 may be configured to be misaligned and aligned with ports and screens, check valves or flappers associated with inner sleeve 120. When misaligned with the ports and/or screens, check valves or flappers within inner sleeve 120, outer frac port 134 may be sealed. When aligned with the ports and/or screens, check valves or flappers within inner sleeve 120, outer frac port 134 may allow frac sleeve 100 to be operational.

In a first mode of operation, outer frac port 134 may be utilized to transport fracking mixtures from a location within the hollow chamber into geological formations positioned adjacent to the outer diameter of outer sidewall 110. In a second mode of operation, outer frac port 134 may be configured to receive natural resources from the geological formations, and the wellbore may be open for production.

Recess 136 may be an opening, orifice, recess, profile etc. extending from the inner diameter of outer sidewall 110 towards the outer diameter of outer sidewall 110. However, the opening associated with recess 136 may not extend completely through outer sidewall 110. Accordingly, a diameter across recess 136 may be larger than the diameter across the inner diameter of outer sidewall 110, but less than the diameter across the outer diameter of outer sidewall 110. In embodiments, recess 136 may be positioned below outer frac port 134, and above vertical adjustable member 138. Responsive to expandable ball seat 152 being vertically aligned with recess 136, the diameter of expandable ball seat 152 may expand with recess 136. Accordingly, recess 136 may be a recession within outer sidewall 110 that is configured to receive expandable ball seat 152.

Vertically adjustable member 138 may be a device or fluid chamber that is configured to compress and elongate to vertically move inner sleeve 120. For example, vertically adjustable member 138 may be a spring, hydraulic lift, etc. In embodiments, a lower surface of vertically adjustable member 138 may positioned on ledge 139, and an upper surface of vertically adjustable member 138 may be positioned adjacent to projection 160 on inner sleeve 120. Responsive to being compressed, vertically adjustable member 138 may shorten the distance between ledge 139 and projection 160. Furthermore, responsive to being compressed, vertically adjustable member 138 may allow inner sleeve 120 to slide within outer sidewall 110. In embodiments, vertically adjustable member 138 may be positioned below recess 136. However, in other embodiments vertically adjustable member 138 may be positioned in various places in relation to inner sleeve.

Lower shear ring 140 may be positioned within outer sidewall 110, and extend into portions of inner sleeve 120. Lower shear ring 140 may be configured to receive force from vertically adjustable member 138, and to secure the lower surface of vertically adjustable member 138 in place. Lower shear ring 140 may be configured to secure the lower surface of inner sleeve 120 in place until a predetermined amount of force is applied within the hollow chamber, or until a predetermined amount of time has lapsed. Responsive to the predetermined amount of force being created or the predetermined amount of time lapsing, lower shear ring 140 may be removed from frac sleeve 100, and allow vertically adjustable member 138 and inner sleeve 120 to slide within the hollow chamber to a second ledge 124.

Second ledge 124 may be positioned proximate to a distal end of frac sleeve 100. Second ledge 124 may be a projection, protrusion, etc. that extends from outer sidewall 110 into the hollow chamber. In embodiments, responsive to lower shear ring 140 being removed, a bottom surface of inner sleeve 120 may slide within the hollow chamber to be positioned adjacent to and on top of second ledge 124. When the distal end of inner sleeve 120 is positioned adjacent to second ledge 124, outer frac port 134 may be aligned inner frac port 150. Furthermore, when the distal most end of inner sleeve 120 is positioned adjacent to second ledge 124, inner sleeve 120 may not be able to slid further towards the distal end of frac sleeve 100.

Inner sleeve 120 may include an inner frac port 150, expandable ball seat 152, and screen, check valve or flapper 154.

Inner frac port 150 may be an opening, orifice, etc. extending through inner sleeve 120. Inner frac port 150 may be configured to control the flow of fluid, fracking materials, and natural resources through the hollow chamber. In embodiments, inner frac port 150 may be configured to be misaligned and aligned with outer frac port 134. When inner frac port 150 is misaligned with the outer frac port 134 and in a first mode, the sidewalls of inner sleeve 120 may form a seal, and may not allow fluid to flow from the hollow into the geological formations via outer frac port 134. In embodiments, when operational, vertically adjustable member 138 may be compressed, this may align inner frac port 150 with outer frac port 134. When aligned inner frac port 150 and outer frac port 134 may form a continuous passageway allowing fracking fluid, other fluid or material to flow from the inner chamber into the geological formations to fracture and/or crack the geological formations.

Expandable ball seat 152 may be configured to secure a frac-ball within the hollow chamber. Expandable ball seat 152 may be comprised of two semi-circles with a hollow center. Expandable ball seat 152 may initially be positioned within a slot on inner sleeve 120, wherein the hollow center of expandable ball seat 152 is configured to have a variable diameter. In other words, expandable ball seat 152 may be substantially donut shaped. The variable diameter of expandable ball seat 152 may change based on a diameter of a structure positioned adjacent to the outer diameter circumference of expandable ball seat 152. Thus, expandable ball seat 152 may expand to have a circumference substantially the same size as the structure positioned adjacent to the outer diameter of expandable ball seat 152 and inside circumference slightly bigger than inner sleeve 120. Accordingly, when expandable ball seat 152 is positioned in the hollow chamber, expandable ball seat 152 may have a first diameter. When expandable ball seat 152 is positioned within recess 136, expandable ball seat 152 may have a second diameter, wherein the first diameter is smaller than the second diameter.

Screen, check valve or flapper 154 may be a filter, semi-permiable passageway, etc. positionined within an opening extending through inner sleeve 120, wherein the opening may be positioned above or below inner frac port 154. In embodiments, when frac-ball 105 is positioned on expandable ball seat 152, Screen, check valve or flapper 154 may be misaligned with outer frac port 134. When expandable ball seat 152 is positioned within recess 136, Screen, check valve or flapper 154 may be aligned with outer frac port 134. Screen, check valve or flapper 154 may allow for the production of natural resources within the geological formations to be transported into the hollow chamber, or allow fluid can be injected back to geological formation. However, screen, check valve or flapper 154 may limit the materials that may traverse into or through screen, check valve or flapper 154. This may limit sand or other undesirable materials from entering the hollow chamber from the geological formation.

One skilled in the art may appreciate that in other embodiments, screen, check valve or flapper 154 may be positioned above inner frac port 150. In these embodiments, recess 136 may be initially positioned below ball seat 152. In implementations, responsive to pumping fracking fluid through the hollow chamber inner frac port 150 may be aligned with outer frac port 134 based on the pressure within the hollow chamber being above a first threshold. Responsive to increasing the pressure within the hollow chamber past a second threshold, vertically adjustable member 138 may compress further and further slide inner frac sleeve 120 towards a distal end of frac sleeve 100. This may align ball seat 152 with the recess initially positioned below ball seat 152. When aligning ball seat 152 with the recess positioned below ball seat 152, screen, check valve or flapper 154 may be aligned with outer frac port 134. As such, in embodiments screen, check valve or flapper 154 may be positioned above or below the port associated with the sliding screen, check valve or flapper, wherein screen, check valve or flapper 154 may also be initially positioned above or below the fixed port associated with the outer sidewall.

Figure 2:
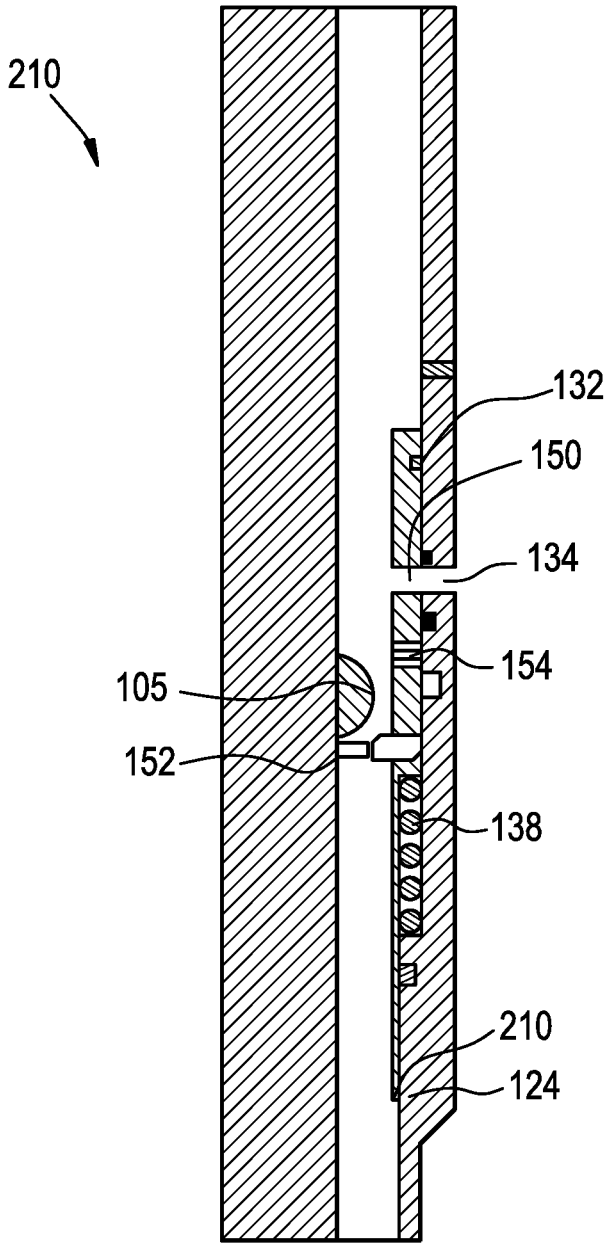
Figure 3:
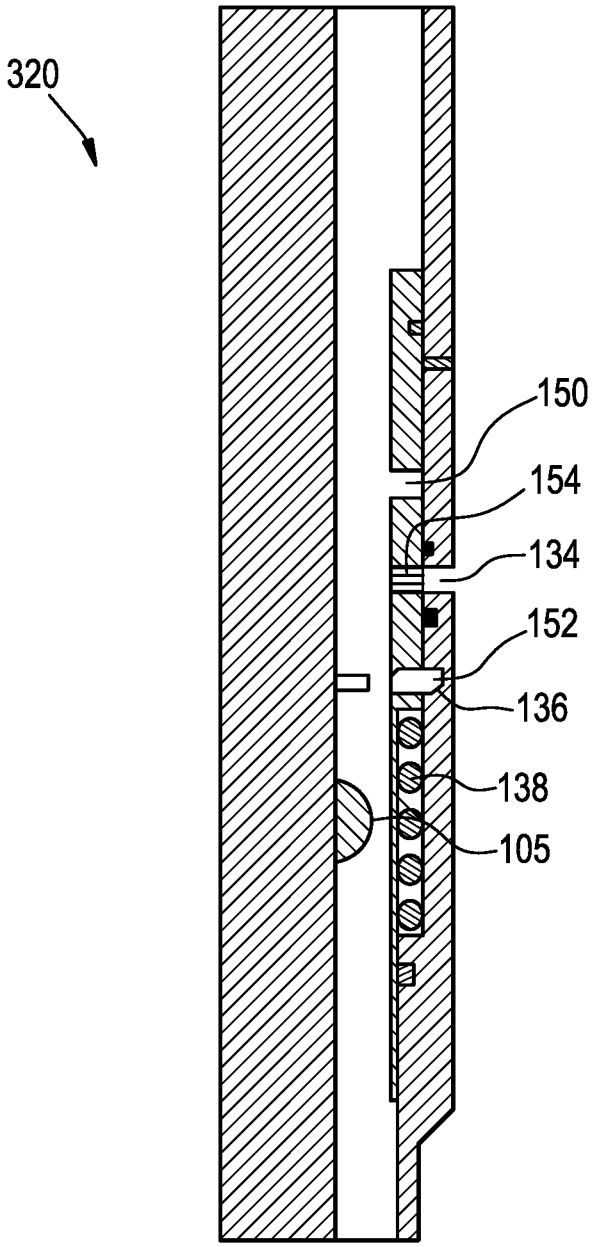

FIGS. 2-3 depicts additional phases of a method 200 for operating a sliding frac sleeve 100. The operations of the method depicted in FIGS. 2-3 are intended to be illustrative. In some embodiments, the method may be accomplished with one or more additional operations not described, and/or without one or more of the operations discussed. Additionally, the order in which the operations of the method are illustrated in FIGS. 2-3 and described below is not intended to be limiting. Elements depicted in FIGS. 2-3 may be described above. For the sake of brevity, a further description of these elements is omitted.

FIG. 2 depicts a first operation 210 utilizing frac sleeve 100. At operation 210, frac sleeve 100 may be positioned within a geological formation with natural resources that are desired to be extracted, or across a geological formation where injection of fluid is desired.

In operation 210, frac ball 105 may be positioned on ball seat 152. When frac-ball 105 is positioned on ball seat 152, a seal across the hollow chamber may be formed allowing pressure to increase within the hollow chamber. Due to the positioning of frac-ball 105 on expandable ball seat 152, the pressure within the hollow chamber may increase past a first threshold and break upper shear screws 132 and compress vertically adjustable member 138. Responsive to compressing vertically adjustable member 138, inner sleeve 120 may move downward to align inner frac port 150 with outer frac port 134 to form a passageway from the hollow chamber, wherein the passageway extends through inner sleeve 120 and outer sidewall 110 and into the geological formation. Utilizing the passageway, a fracking mixture, fluid or material may be moved from the hollow chamber into the geological formation encompassing frac sleeve 100.

Furthermore, when frac ports 150, 134 are aligned, screen, check valve or flapper 154 may be misaligned with outer frac port 134.

FIG. 3 depicts a second operation 220 utilizing frac sleeve 100. At operation 220, the pressure within the hollow chamber may decrease by no longer pumping fracking fluid through the hollow chamber. This may allow vertical adjustable member 138 to expand, and inner sleeve 120 may upwardly slide. When inner sleeve 120 moves upward, expandable ball seat 152 may be vertically aligned with recess 136.

Responsive to aligning expandable ball seat 152 and recess 136, expandable ball seat 152 may expand, increasing the inner, open, circumference of expandable ball seat 152. When increasing the inner diameter of expandable ball seat 152, frac ball 105 may have a diameter that is less than the inner diameter of expandable ball seat 152. Thus, expandable ball seat may not be able to support frac-ball 105, and frac-ball may move downward through the vertically adjustable member 138 and out the distal end of frac sleeve 100.

Additionally, responsive to aligning expandable ball seat 152 and recess 136, screen, check valve or flapper 154 may be vertically aligned with outer frac port 134. Elements from the geological formation may be able to flow into the hollow chamber via outer frac port 134 and screen, check valve or flapper 154, wherein screen, check valve or flapper 154 may be configured to filter larger elements, such as sand, to enter the hollow chamber.

After consuming all balls associated with the system, an intervention tool can be lowered in the well and intervention tool locator can be used to locate the desired frac sleeve where the intervention tool will straddle and treat the corresponding geological formation the frac sleeve it is set against.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A frac sleeve comprising:

an inner sleeve configured to move relative to a fixed outer sidewall;

an inner frac port positioned through a circumference of the inner sleeve;

a screen or one way valve positioned through the circumference of the inner sleeve, the screen or one way valve and the inner frac port being offset from each other;

an outer production port positioned through the fixed outer sidewall, the outer production port configured to be aligned with the inner frac port in a first mode when a pressure within a central bore is greater than a first threshold and the screen or one way valve in a second mode when the pressure within the central bore is less than or equal to the first threshold;

a seat configured to selectively secure an object in place to control the pressure within central bore, a recess configured to receive the seat responsive to decreasing the pressure within the central bore when the seat that selectively secures the object is aligned with the recess, the recess being an indentation within the outer sidewall extending from an inner circumference of the outer sidewall towards an outer circumference of the outer sidewall.

2. The frac sleeve of claim 1, wherein the screen or one way valve is positioned more proximate to a distal end of the inner sleeve than the inner frac port.

3. The frac sleeve of claim 1, wherein the screen or one way valve is positioned more proximate to a proximal end of the inner sleeve than the inner frac port.

4. The frac sleeve of claim 1, further comprising:

an adjustable member that is configured to compress and elongate.

5. The frac sleeve of claim 4, wherein in the first mode the adjustable member is compressed, and in the second mode the adjustable member is elongated.

6. The frac sleeve of claim 1, wherein the screen or one way valve is configured to filter materials entering the frac sleeve through the outer production port.

7. The frac sleeve of claim 1, wherein the recess is positioned below the outer production port, wherein the seat is configured to be aligned with the recess after the pressure within the central bore is increased to be greater than the first threshold followed by decreasing the pressure within the central bore to be less than or equal to the first threshold.

8. The frac sleeve of claim 1, wherein in the second mode the screen or one way valve is configured to be positioned directly adjacent to the outer production port.

9. The frac sleeve of claim 1, wherein in the first mode the screen or one way valve is misaligned with the outer production port.

10. The frac sleeve of claim 1, wherein the screen or one way valve is configured to be aligned with the outer frac port during a production stage of a wellbore.

11. A method utilizing a frac sleeve comprising:

sliding an inner sleeve relative to a fixed outer sidewall, the inner sleeve including an inner frac port positioned through a circumference of the inner sleeve, and a screen or one way valve positioned through the circumference of the inner sleeve, the screen or one way valve and the inner frac port being offset from each other, the fixed outer sidewall including an outer production port positioned through the fixed outer sidewall;

increasing a pressure within a central bore;

aligning the outer production port with the inner frac port in a first mode when the pressure within the central bore is greater than a first threshold;

decreasing the pressure within the central bore;

selectively securing an object in place on a seat to control the pressure within the central bore;

positioning the seat within a recess responsive to decreasing the pressure within the central bore when the seat that selectively secures the object is aligned with the recess, the recess being an indentation within the outer sidewall extending from an inner circumference of the outer sidewall towards an outer circumference of the outer sidewall; and aligning the outer production port with the screen or one way valve in a second mode when the pressure within the central bore is less or equal to the first threshold.

12. The method of claim 11, wherein the screen or one way valve is positioned more proximate to a distal end of the inner sleeve than the inner frac port.

13. The method of claim 11, wherein the screen or one way valve is positioned more proximate to a proximal end of the inner sleeve than the inner frac port.

14. The method of claim 11, further comprising:

compressing or elongating an adjustable member based on the pressure within the frac sleeve.

15. The method of claim 14, wherein in the first mode the adjustable member is compressed, and in the second mode the adjustable member is elongated.

16. The method of claim 11, further comprising:

filtering, via the screen or one way valve, materials entering the frac sleeve through the outer production port.

17. The method of claim 11, wherein the recess is positioned below the outer production port, wherein the seat is configured to be aligned with the recess after the increasing and the decreasing pressure within the central bore.

18. The method of claim 11, wherein in the second mode the screen or one way valve is configured to be positioned directly adjacent to the outer production port.

19. The method of claim 11, wherein in the first mode the screen or one way valve is misaligned with the outer production port.

20. The method of claim 11, wherein the screen or one way valve is configured to be aligned with the outer frac port during a production stage of a wellbore.

* * * * *